United States Patent [19]

Kuklies et al.

[11] 4,360,170

[45] Nov. 23, 1982

[54] ROLL WINDER FOR LARGE DIAMETER ROLLS

[75] Inventors: Milton C. Kuklies, Temple, Tex.; George J. Reimann, Pittsford, N.Y.

[73] Assignee: Mobil Oil Corporation, New York, N.Y.

[21] Appl. No.: 221,714

[22] Filed: Dec. 31, 1980

[51] Int. Cl.[3] ..... B65H 19/20

[52] U.S. Cl. ..... 242/56 R; 242/67.1 R

[58] Field of Search ..... 242/67.1 R, 56 R, 56 A, 242/64

[56] References Cited

U.S. PATENT DOCUMENTS 2,676,764 4/1954 Aulen ..... 242/56 R 2,830,775 4/1958 Kiesel ..... 242/56 R 3,044,726 7/1962 Schellenberg ..... 242/56 R

*Primary Examiner*—Edward J. McCarthy

*Attorney, Agent, or Firm*—C. A. Huggett; M. G. Gilman; J. F. Powers, Jr.

[57] ABSTRACT

An apparatus and method for the uninterrupted winding of continuously-fed malleable sheet material, such as plastic, paper, and textiles, which includes a roll feed mechanism, a first and second winding station, a sheet directing main frame which may be biased in the direction of either winding station so as to press the sheet onto the take up spindle located at the particular station, a sheet transfer means and an external control connected thereto in order to selectively transfer the continuously-feeding sheet from a full spindle to an empty spindle mounted at one of the winding stations.

4 Claims, 5 Drawing Figures

ROLL WINDER FOR LARGE DIAMETER ROLLS

BACKGROUND OF THE INVENTION

1. Field of the Invention

The present invention relates to mechanical winding machines which are designed to wind large diameter rolls of a continuously-feeding web or film and, more particularly, to a simple mechanical high-speed winder capable of the semi-automatic transfer of the web or film from a full to an empty spindle.

The overall operating efficiency of industries producing high volume malleable sheet-like material such as plastic, paper, etc. requires a method by which a continuously conveyed web or film can be (1) safely removed from the output station of the web-producing machine or process, (2) packed in a readily useable manner, and (3) stored efficiently. Quite evidently, in order to accommodate any high speed production, the method of film retrieval should be as rapid as possible, but it must also be sufficiently precise so as to minimize or avoid damage to the product. Furthermore, in order to maintain an efficient operation, the entire retrieval process should be characterized by the use of simple mechanisms which are capable of being quickly and easily repaired in case of a mechanical malfunction or breakdown. Consequently, the art of mechanical winding of continuously-fed or conveyed webs or films has become very important to industries involved in such production.

Efforts to satisfy the above requirements account for the continuing development of the art of winding sheet product rolls in the plastic, textile, and paper industries. Large diameter rolls, in particular, provide a convenient means for safely accumulating, at either high or low speed, the continuously produced web or film. Furthermore, rolls of sheet product are easy to handle with conventional warehousing and shipping equipment.

2. Discussion of the Prior Art

Conventional mechanical winding devices basically include at least one winding base which accommodates a winding spindle onto which there is guided a sheet product, and a power source which drives the spindle in a preferred rotational direction so that the sheet is accumulated or wound on the spindle. The speed of rotation is essentially dependent upon the speed at which the sheet is produced. In the textile industry the necessarily utilized rotational speed is not as high as in the plastic and paper industries.

Known methods of winding also provide for apparatus which include a stationary guiding device for receiving the sheet product from the output station and directing it to the spindle which is mounted on the winding base at the only winding position. Upon accumulation or winding of the desired amount of sheet on the spindle, an empty spindle must be introduced to the exact same winding position as the full spindle so as to be able to receive the sheet product as it exits from the stationary guiding device. The replacement procedure used to change from the full to the empty spindle is quite critical to the retrieval efficiency of the sheet product, since, in any continuous output process any downtime reduces efficiency and increases production costs.

One method of retrieving sheet product, generally associated with the textile industry, incorporates a simple winding spindle secured in a stand at a winding station and rotated about its own axis by a portable hydraulic or electric motor. After the roll is wound to the desired amount, the web is manually transferred to an empty spindle while the full roll together with support stand is removed from the winding station and replaced with the empty spindle and its accompanying support stand. This method, however, is not amenable to high speed product retrieval because the manual web-exchange technique would not be capable of accommodating high speed sheet output such as is necessitated in the plastics and paper industry. It is also inconvenient because a machine tenderer must be constantly available to perform the required manual changeover procedure.

Another well known method of winding large diameter rolls involves the use of a turret-type winder which is generally characterized by a stationary base having a rotatable turret head which, in turn, has two or more spindle-accommodating positions. In use, a machine operator mounts an empty spindle at a spindle-accommodating position and, thereafter, the turret head is rotated to place the spindle at a specific winding station adjacent to the sheet guiding device. Then the spindle is then rotated by an electric motor about its own axis, and the web or plastic film is wound thereon. Once a roll of desired size has been wound, the turret is rotated or indexed about its axis so that an empty spindle is brought into winding position, the web is automatically cut off and is concurrently automatically transferred from the full spindle onto the empty spindle. The full roll is then removed manually from the winder by the operator. As the full spindle is rotated away from the winding station the path of the continuously-fed sheet product is of necessity distorted to follow the moving take-up spindle. Therefore, a sophisticated and multi-component system of drives must be employed in order to avoid sideways slippage of the sheet. Furthermore, the entire turret-type apparatus is constituted of expensive and complicated equipment demanding a comparatively expensive support package consisting of a large supply of different types of parts and requiring highly trained technicians to maintain continuous operation.

SUMMARY OF THE INVENTION

Accordingly, the present invention is intended to provide a simple, low cost apparatus and method for the uninterrupted recovery of a continuously-fed malleable sheet material.

It is another object of the present invention to provide the type of apparatus referred to hereinabove which is capable of winding large diameter rolls at high speeds.

A still further object of this invention is to eliminate to a large extent the need for the manual operation and/or support of an uninterrupted sheet recovery process.

Notwithstanding the dominant concept of a single-position retrieval apparatus, the present invention relates to a unique apparatus and method for the uninterrupted winding of a continuously-produced malleable sheet material capable of both low and high speed large-diameter roll winding, wherein two winding stations are employed at which winding spindles may be positioned on spindle support stands until a spindle is adequately filled. The continuously-fed sheet is directed from the output station of the sheet-producing source by a roll feed mechanism to a sheet directing main frame which is located between the winding stations and is movable therebetween so as to be capable of guiding the sheet onto a spindle at either station. A sheet transfer device, in turn, is rotatably mounted on the sheet directing main frame through which the sheet must pass on its path to a spindle.

The transfer means includes a sheet transfer arm, on which two transfer rolls are attached, and a cutting means all of which are cooperatively interconnected and controlled by an external control which, when activated, causes the transfer means to initiate accumulation of the sheet on an empty spindle at one of the winding stations while simultaneously terminating the accumulation of the sheet on the spindle at the other winding station.

The effect of this mechanism is to provide a simple mechanical high speed winder which is capable of winding large diameter rolls and performing a safe and simple semi-automatic transfer of the winding sheet from a full to an empty spindle.

In the preferred embodiment there is also provided a main frame biasing device which maintains a compression nip between a sheet lay-on roll mounted on the main frame and the accumulating spindle. This constant compression nip is especially desirable in order to prevent slippage of the sheet as it is guided onto the spindle.

BRIEF DESCRIPTION OF THE DRAWINGS

For a better understanding of the present invention, together with other and further objects, reference is made to the following description, taken in conjunction with the accompanying drawings; in which.

DETAILED DESCRIPTION OF THE INVENTION

Figure 1:
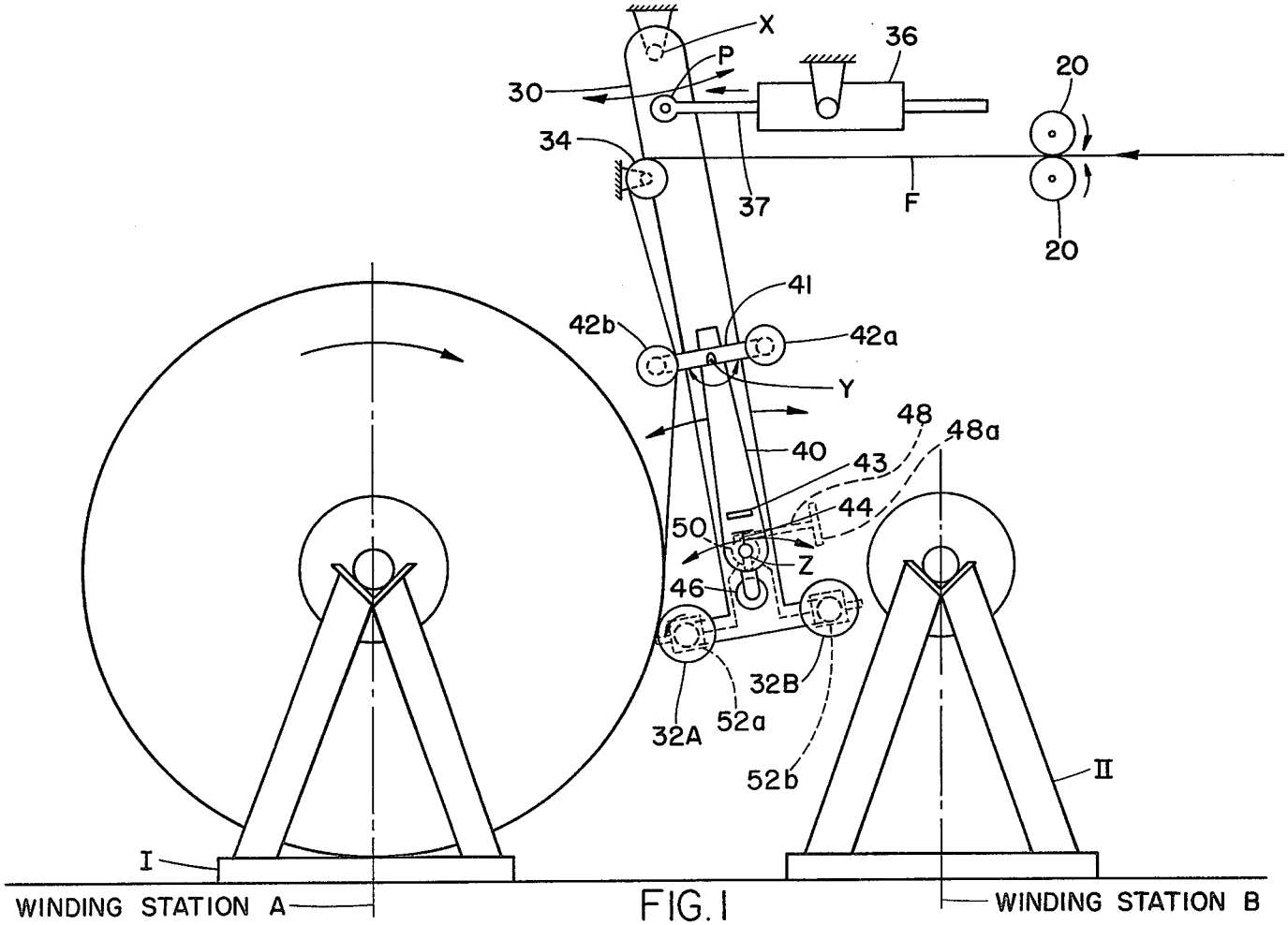
FIG. 1 is a schematic side elevational view of an apparatus pursuant to the present invention.

In FIG. 1 a continuously formed sheet F is pulled from a sheet-producing source by infeed nip rolls 20. Sheet F may be any continuously produced film or web, such as a polyethylene plastic sheet, paper, textiles, etc. Calendering, laminating, or any other treatment which may be performed on the sheet so as to produce a special effect thereon is completed prior to the sheet being conveyed to infeed rolls 20. The sheet then passes over idler roll 34 where its path of motion is changed to coincide with the general direction towards winding stations A and B which are designed to, respectively, accommodate spindle supports I and II. Depending upon the station at which the sheet is being wound, the film then passes over one of the film transfer rolls, 42*a* and 42*b*, and thence between one of film lay-on rolls, 32A and 32B, and the particular spindle on which the sheet is being wound or accumulated.

The sheet directing main frame 30 is shown in the embodiment herein as rotatably suspended from pivot X. At the opposite end of the frame 30 two film lay-on rolls 32A and 32B are mounted on, respectively, the sides adjacent winding stations A and B. In operation, the film lay-on rolls press the sheet onto the desired spindle by the formation of a compression nip between the particular spindle and the respective lay-on roll. The force required to form the compression nip is generated by air cylinder 36 which may be selectively activated to push or pull the main frame via push-pull rod 37 attached to the main frame 30 at pivot P. The air cylinder acts as a pneumatic spring, for example, only one side of the cylinder is pressurized while the other side is vented to atmosphere. Thus, as the diameter of the wound roll increases, the main frame 30 is being rotated by the wound roll about pivot X against the air pressure in the air cylinder; the constant pressure applied thereby prevents the entrapment of air between the layers of wound sheet material. While the present embodiment shows a suspended main frame, the invention contemplates any suitable arrangement of a main frame wherein the sheet may be guided from a feed mechanism, such as infeed nip 20, to alternate winding stations. This concept requires primarily that, all other features being equivalent, the frame be movable between winding stations, and it is intended to claim all other embodiments that may be encompassed thereby.

In order to transfer the continuously feeding sheet from one winding station to another winding station without interrupting the winding process, a sheet transfer device is provided which includes a transfer arm 40 rotatably attached to the main frame 30 at pivot Z, a transfer roll frame 41 which is, in turn, rotatably attached to transfer arm 40 at pivot Y. Transfer rolls 42*a* and 42*b* are mounted on either end of transfer roll frame 41. The transfer device also includes a film support rail 43, film cut-off knife 44 which may be partially rotated about its mounting axis which coincides with pivot Z, and a transfer idle roll 46.

Figure 3:
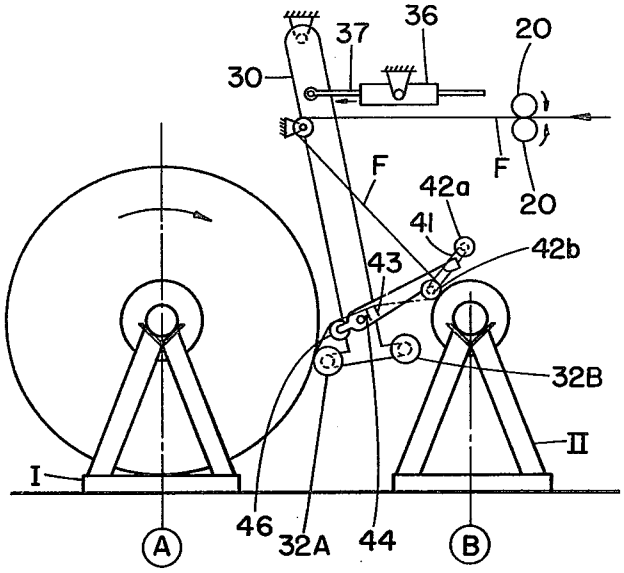
FIGS. 2–5 show views of the invention similar to FIG. 1, except that they depict the invention in different stages which represent the varied operations which the apparatus performs to continuously wind the sheet without interruption.
Figure 2:
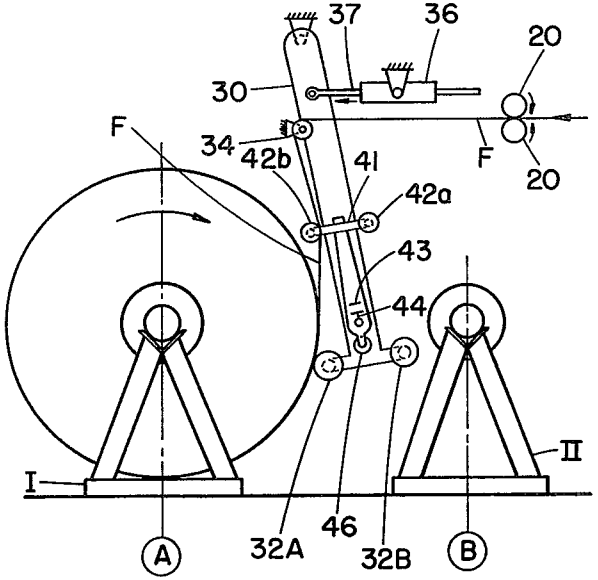

The transfer arm 40 has an external control 48 shown diagrammatically in FIG. 1 by which an operator may rotate the arm away from a full spindle and towards an empty spindle mounted at either of the winding stations. This control 48 may be a shaft extension at pivot Z having a worm gear fixed thereon. The worm gear is engaged by a worm adapted to be manually rotated through a handwheel 48A for rotating the transfer arm 40. Transfer roll frame 41 is cooperatively interconnected with the transfer arm 40, for instance, by a sprocket and chain system (not shown) so that, when the transfer arm is rotated in one direction (e.g. clockwise), the transfer roll frame is rotated in the opposite direction (i.e. counterclockwise). For example, in FIG. 2, the transfer arm 40 in the neutral position is generally upright as the spindle at winding station A is filled. Once the roll at station A is wound to the desired size, an operator rotates the transfer arm 40 clockwise about pivot Z towards the spindle mounted at winding station B. Simultaneously, the transfer roll frame 41 rotates in a counterclockwise direction thereby guiding the sheet which is traveling over transfer roll 42*b* towards the spindle at station B until the sheet is contacted with the empty spindle as is depicted in FIG. 3. At this instance the sheet, which is traveling from the empty spindle at B thence over sheet support rail 43, transfer idler roll 46 and film lay-on roll 32A, is still being accumulated on the spindle at station A until the transfer roll 42*b* contacts the empty spindle with a predetermined amount of force sufficient to activate the cutoff knife 44. The amount of force necessary to activate the cutoff knife may be determined, for instance, by a sensor such as a spring-loaded cylinder 50 having a valve arrangement at either end which allows a compressed fluid, such as air to pass to a portion of the cutoff knife causing the latter to rotate about its axis Z. The valve arrangement includes air valves 52A and 52B mounted on the pivots for, respectively, rolls 32A and 32B, and incorporating projecting detents adapted to press against the respective empty spindle.

In the illustration shown in FIG. 3, the knife blade 42, which is preferably a thin piece of steel with many sharp points, is rotated counterclockwise upon activation of the sensor mechanism, thereby cutting through the moving sheet and separating it from the sheet which is being wound at Station A.

At the same time, the film transfer roll **42*b*, which may be covered with soft rubber, presses the sheet against the winding spindle at station B. In the case of producing polyethylene plastic sheet, the outside of the winding spindle is preferably covered by a strip of sticky or adhesive tape which is adherent on both sides. Thus, after the cut through the sheet is completed, a small portion of the sheet between the cutoff point and the nip formed by the transfer roll 42*b* and the empty spindle is free so as to be adapted for take up on the empty spindle at winding station B. Furthermore, the film transfer roll 42*b*** presses the oncoming sheet against the adhesive tape causing the sheet to adhere to the empty spindle; thereby intitiating the winding operation at winding station B.

Figure 4:
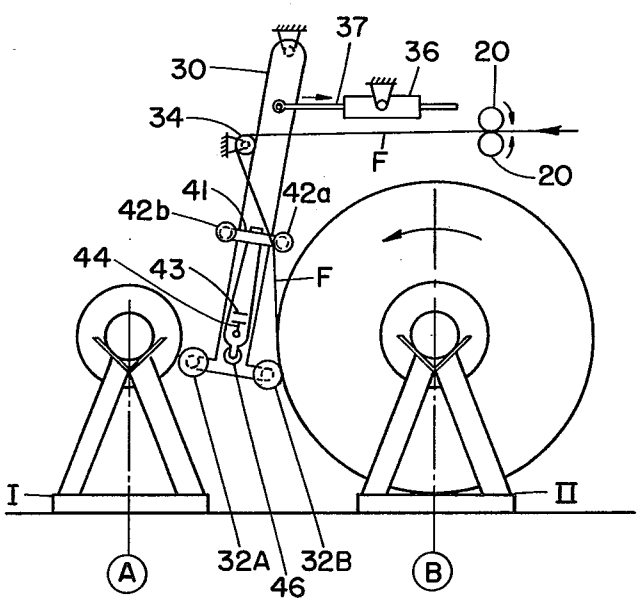

At this point the operator may stop the rotation of the full spindle at station A, return the film transfer arm into the neutral position and allow the sheet material to accumulate or wind on the empty spindle at B as depicted in FIG. 4. While the sheet is accumulating on the spindle at station B, film lay-on roll 32B presses the sheet against the spindle. Accordingly, the operation of the air cylinder 36 is reversed so that the rod 37 is pulled in the direction of the arrow shown in FIG. 4.

Figure 5:
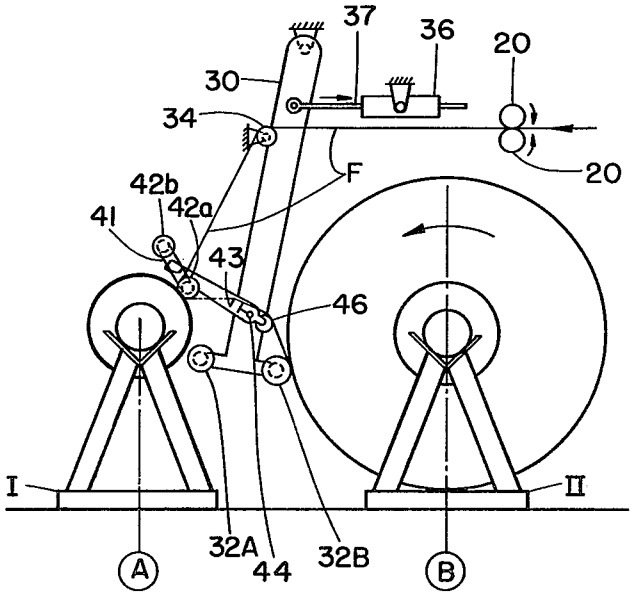

FIG. 5 shows the operation of the transfer device as it transfers the sheet from a full spindle at station B to an empty spindle at station A. The exact sequence of operation takes place as described hereinabove, except that transfer arm 40 is rotated counterclockwise causing transfer roll frame 41 to rotate clockwise, and cutoff knife 44 to rotate clockwise.

During the sheet cutting operation, in effect, in both FIG. 3 and FIG. 5, the sheet is supported as a short free span between support rail 43 and transfer idler roll 46 with the cutoff blade position therebetween, thus facilitating an easy cutoff procedure.

While there has been described what is presently believed to be the preferred embodiment of the invention, those skilled in the art will realize that changes and modifications may be made thereto without departing from the spirit of the invention, and it is intended to claim all such changes and modifications as fall within the true scope of the invention.

What is claimed is:

1. An apparatus for winding a continuously-fed malleable sheet material comprising: a roll feed mechanism for directing said sheet material from a sheet producing source; first and a second winding stations at which winding spindles are positioned on spindle stands for receiving the continuously fed sheet; a sheet directing main frame movably mounted directly downstream of said feed mechanism in the sheet feeding direction and being located intermediate said first and second winding stations for receipt of said sheet material from said feed mechanism and adapted to guide said material to respectively one of said first and said second winding stations; a sheet transfer means rotatably mounted on an intermediate portion of said main frame, said sheet passing through said transfer means during conveyance to one of said winding stations; an external control means connected to said transfer means activatable to rotate said transfer means away from one of said winding stations to the other of said winding stations and to transfer said sheet from the spindle located at one of said stations to the spindle located at the other of said stations, said main frame comprising a frame body having a first end at which said frame is rotatably mounted and a second end; a main frame biasing means selectively forcing said second end of said frame body in a direction towards one of said first and said second winding stations; and first and second sheet lay-on rolls mounted on said second end whereby said first lay-on roll forms a pressure nip with the spindle at said first winding station when said biasing means forces said second end toward said first winding position and said second lay-on roll forms a pressure nip with the spindle at said second winding station when said biasing means forces said second end toward said second winding position.

2. An apparatus as claimed in claim 1, said biasing means comprises an air cylinder and a push-pull rod mounted for reciprocation in said cylinder, said rod being pivotably connected at one end to said frame body so that when said rod is reciprocated said frame body is correspondingly rotated about said rotatably mounted first end to thereby bias said second end towards one of said winding stations.

3. An apparatus as claimed in claim 1, said sheet transfer means comprising a transfer roll frame rotatably mounted to said transfer means and having two free ends; a first and a second transfer roll affixed to said ends of said arm so that said sheet must pass over the transfer roll located nearest to the winding station where said sheet is being accumulated; said transfer roll frame being cooperatively interconnected to said transfer means so that when said transfer means is activated by said external control means said transfer roll frame is simultaneously engaged to guide said sheet away from a full spindle at one of said winding stations to contact with an empty spindle at the other said winding station; and cutting means for severing said sheet upon contacting said sheet with said empty spindle, said cutting means being mounted on said transfer means at a point downstream of said transfer roll in the feed direction so that when said sheet is severed a free portion of said sheet beyond the point of contact between said transfer roll and said empty spindle is rendered available for take-up on said empty spindle.

4. An apparatus as claimed in claim 3, said cutting means comprising a pressure-sensitive turning means and a blade pivotably mounted on said transfer means and being oriented transversely of said sheet, said turning means being operatively connected to said transfer rolls and to said blade whereby, when one of said transfer rolls contacts said sheet with said empty spindle, the pressure exerted thereby on said transfer roll causes said turning means to turn said blade to a position for cutting said sheet.

* * * * *